US008220836B2

(12) United States Patent
Chatte

(10) Patent No.: US 8,220,836 B2
(45) Date of Patent: Jul. 17, 2012

(54) METHOD OF PROCESSING REPLY CARDS

(75) Inventor: Fabien Chatte, Nogent sur Marne (FR)

(73) Assignee: Neopost Technologies, Bagneux (FR)

( * ) Notice: Subject to any disclaimer, the term of this patent is extended or adjusted under 35 U.S.C. 154(b) by 300 days.

(21) Appl. No.: 12/621,008

(22) Filed: Nov. 18, 2009

(65) Prior Publication Data

US 2010/0133803 A1 Jun. 3, 2010

(30) Foreign Application Priority Data

Nov. 25, 2008 (FR) ..... 08 58004

(51) Int. Cl.
*B42D 1/00* (2006.01)
*B42D 19/00* (2006.01)
*B42D 15/00* (2006.01)

(52) U.S. Cl. ..... 283/67; 281/2; 281/5; 283/61; 283/62; 283/83; 283/98; 283/100; 283/105

(58) Field of Classification Search ..... 281/2, 5; 283/5, 61, 62, 67, 83, 94, 98, 100, 105
See application file for complete search history.

(56) References Cited

U.S. PATENT DOCUMENTS 3,203,116 A * 8/1965 Shaw et al. ..... 283/83
5,599,046 A * 2/1997 Behm et al. ..... 283/83
5,818,019 A 10/1998 Irwin, Jr. et al.
6,174,579 B1 * 1/2001 Slyster et al. ..... 283/67
7,236,093 B2 * 6/2007 Stromberg ..... 283/81
7,304,578 B1 12/2007 Sayers et al.
2004/0074958 A1 4/2004 Foth et al.
2005/0177480 A1 * 8/2005 Huang ..... 705/34
2008/0272194 A1 * 11/2008 Chaum ..... 283/5
2009/0289115 A1 * 11/2009 Chung et al. ..... 283/5

FOREIGN PATENT DOCUMENTS

GB 2 437 177 A 10/2007

* cited by examiner

*Primary Examiner* — Edward Tolan
*Assistant Examiner* — Justin Lewis
(74) *Attorney, Agent, or Firm* — Sughrue Mion, PLLC

(57) ABSTRACT

In a reply card enabling a recipient of said reply card to answer at least one request made by a sender of said reply card by taking a determined physical action on at least one identified zone of said reply card, provision is made for at least one identified zone of said reply card to be provided with a succession of signs printed with a conductive ink, and for a determined physical action to be taken that consists in perforating at least one of said identified zones so as to detach at least a portion of said succession of signs printed with a conductive ink from the reply card, the effect of said detaching being to prevent a radio-frequency read device possessed by the sender from receiving the answer associated with said succession of signs printed with a conductive ink and detached by the recipient.

9 Claims, 2 Drawing Sheets

METHOD OF PROCESSING REPLY CARDS

TECHNICAL FIELD

The present invention relates exclusively to the field of mail handling, and it relates more particularly to a method of processing reply cards, and to the associated reply cards.

PRIOR ART

Even nowadays, despite the rapid development of electronic commerce or "e-commerce" since the advent of the Internet, retailers and other traders still send their customers and prospective customers or "prospects" mail including reply cards for returning after answering the sender's questions or requests by marking various boxes present on the reply cards.

Processing such a reply card requires the sender to perform various operations, namely opening the envelope containing the reply card, extracting the card, and reading the information put on it by the recipient so as to match up that information with the sender's relevant data relating to the sending of the reply cards. Such processing is costly because either it is performed manually and therefore requires major human resources, or else it is automated and therefore requires suitable technical means for opening the envelopes, extracting the reply cards, and reading the information put on the reply cards.

Consideration has been given to obviating the need for opening and extracting means by providing the reply cards with Radio-Frequency Identification (RFID) tags because such tags can be read without contact and therefore without opening the envelopes. Unfortunately, such a solution can hardly be entertained on a large scale because it presupposes that each potential recipient has an RFID reader/recorder available at home, which is not so currently.

There therefore exists a need that is currently unsatisfied for a method of processing such reply cards that makes it possible to limit the costs of processing by the sender while also limiting the constraints imposed upon the recipient.

OBJECT AND DEFINITION OF THE INVENTION

The present invention thus proposes to mitigate the above-mentioned drawbacks by providing a method of processing a reply card returned by its recipient, the method being performed by a sender of said reply card, in which reply card said recipient has answered at least one request made by said sender by taking at least one determined physical action on at least one identified zone of said reply card, wherein said method includes radio-frequency analysis of said reply card by a radio-frequency read device for the purpose of determining whether or not said at least one identified zone is provided with a succession of signs printed with a conductive ink, the radio-frequency image of the positions of the signs making it possible to interpret the answer given by said recipient to said at least one request made by said sender as a function of whether or not said succession of signs printed with conductive ink in said at least one identified zone is present.

Thus, with this simple structure, it is no longer necessary to open the envelopes in order to become acquainted with the recipient's answers, and interpreting said answers requires only a low-cost read device that is, in addition, simple to integrate into a mail-handling machine without modifying the general structure thereof.

Said determined physical action consists in perforating at least one said identified zone so as to detach at least a portion of said succession of signs printed with a conductive ink from said reply card, the effect of said detaching being to prevent a radio-frequency read device possessed by the sender from receiving the answer associated with said succession of signs printed with a conductive ink and detached by the recipient.

Preferably, said radio-frequency analysis further includes recognition of the recipient based on a unique identification code printed with a conductive ink in another identified zone of said reply card.

Advantageously, said unique identification code is associated in a database with a recipient address scanned or printed during the processing of said reply card that is performed by said sender.

The invention also provides a reply card enabling a recipient of said reply card to answer at least one request made by a sender of said reply card by taking a determined physical action on at least one identified zone of said reply card, wherein said at least one identified zone is provided with a succession of signs printed with a conductive ink, and wherein said determined physical action consists in perforating at least one said identified zone so as to detach at least a portion of said succession of signs printed with a conductive ink from said reply card, the effect of said detaching being to prevent a radio-frequency read device possessed by the sender from receiving the answer associated with said succession of signs printed with a conductive ink and detached by the recipient.

Preferably, said reply card bears a unique identification code printed with a conductive ink in another identified zone of said reply card and designed to make it possible to recognize the recipient.

Advantageously, said conductive ink is a metallic ink.

The invention also provides a module of a mail-handling machine, which module is suitable for enabling a reply card returned by its recipient to its sender to be processed by said sender, and in which reply card said recipient has answered at least one request made by said sender by taking at least one determined physical action on at least one identified zone of said reply card, wherein said module includes a radio-frequency analysis device for using radio-frequency analysis of said reply card to determine whether or not said at least one identified zone is provided with a succession of signs printed with a conductive ink, the radio-frequency image of the positions of the signs making it possible to interpret the answer given by said recipient to said at least one request made by said sender as a function of whether or not said succession of signs printed with conductive ink in said at least one identified zone is present.

Preferably, said radio-frequency read device also recognizes the recipient on the basis of a radio-frequency analysis of a unique identification code printed with a conductive ink in another identified zone of said reply card.

Advantageously, said module is connected to a database in which said unique identification code is associated with a recipient address scanned or printed while said reply card is being processed by said sender.

Depending on the available space, the module may be mounted in one of the following modules of the mail-handling machine: a folder/stuffer, a feeder, dynamic scales, a franking machine, and a mailpiece-receiving magazine.

BRIEF DESCRIPTION OF THE DRAWINGS

The invention can be better understood from the following detailed description accompanied by illustrative and non-limiting examples with reference to the following figures, in which.

DETAILED DESCRIPTION OF EMBODIMENTS

Figure 1:
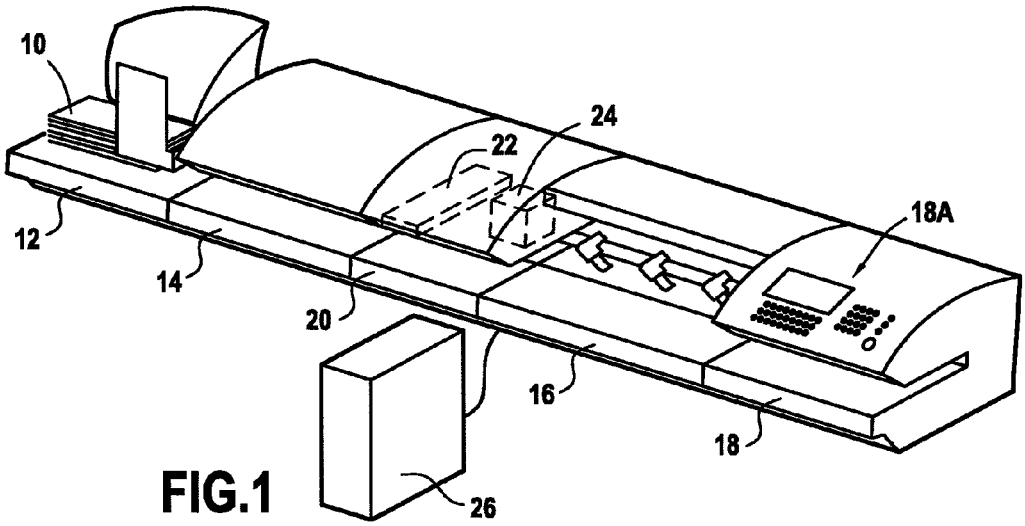
FIG. 1 is an overall view of a mail-handling machine implementing the invention.

FIG. 1 shows an example of a mail-handling machine that, as is known and disposed going from upstream to downstream in the direction in which the mailpieces 10 advance, comprises: a mailpiece feed module 12 designed to receive a stack of mailpieces that are typically constituted by mixed mail (i.e. mailpieces of different sizes and weights); a selector and conveyor module 14 for selecting and conveying the mailpieces one-by-one; preferably a dynamic weigh module 16 (dynamic scales) for determining the weight and optionally the size of each selected mailpiece; and a print module 18 designed to print a postal imprint on each of the mailpieces selected one-by-one in this manner. The print module is preferably, as is also known, connected to a server (not shown) of a dealer of the machine, itself also connected to a server (not shown) of a postal authority or of a private carrier delivering the mail. The mailpieces that are franked are then ejected into an unloading tray (or a mailpiece-receiving magazine) that is not shown.

The mail-handling machine further comprises an independent module 20 disposed upstream from the dynamic weigh module (although it may be disposed otherwise) for acquiring a digital image of the mailpiece 10 and for extracting therefrom various data necessary for processing it and for tracking it, such as the recipient address or a unique identifier or tag put on the mailpiece when such a tag exists.

For this purpose, this module includes a scanner device provided with an image sensor 22 associated with bar code recognition and Optical Character Recognition (OCR) software. The sensor is advantageously a Contact Image Sensor (CIS) of the linear type of length suitable for scanning at least a width of a mailpiece that covers the postal imprint and the recipient address regardless of the format of the mailpiece. The linear image sensor is typically an integrated module including adjacent Charged Coupled Device (CCD) semiconductor or Complementary Metal Oxide Semiconductor (CMOS) detector cells, collimation optics, and a lighting system which, when it is activated, illuminates the surface on which the sensor is positioned, and, in return, at each of the detection cells, delivers a signal that is proportional to the light reflected by the surface of the mailpiece.

The print module also includes a user interface 18A with a keyboard making it possible to display on a screen all or some of the image that is scanned in this way by the contact image sensor 22 and, if necessary, to correct the postal data extracted from said image. The keyboard can be a physical keyboard interacting with a virtual keyboard of the screen that is then advantageously of the touch-sensitive type, or else the keyboard can be purely and simply replaced with such a touch-sensitive screen.

In accordance with the invention, the module 20 further includes a read device 24 suitable for reading a plurality of codes, each of which is formed by a succession of signs printed previously with a conductive ink on the reply card using the technique that is known and illustrated in particular by U.S. Pat. No. 6,819,244 to Inksure RF Inc. These read means are constituted by radio-frequency means (antenna and reception circuit) and recognition means that, from the radio-frequency image of the positions of the signs in the read code and from a mathematical analysis of the signals received, make it possible to recognize with certainty the code initially printed with conductive ink. In addition, storage means 26 of the database type are provided for storing the image of the envelope scanned in this way, and the various data that it bears, in particular the data relating to the questions asked.

It should be noted that the read means differ from RFID read means that in no way perform any recognition (by mathematical analysis) of a radio-frequency image but rather merely read a code transmitted by the electronic chip of the transponder.

Figure 2B:
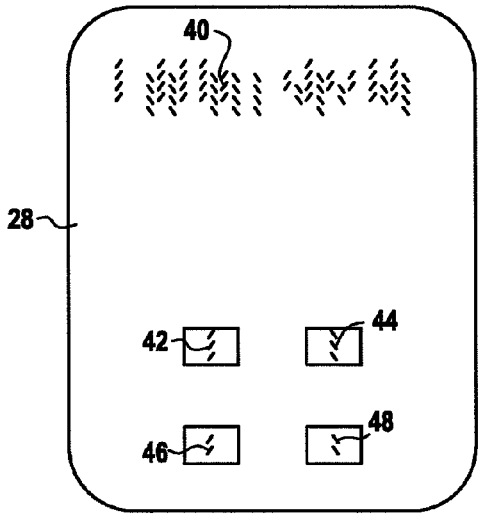
FIGS. 2A, 2B, and 3 show a reply card used in implementing the invention.
Figure 2A:
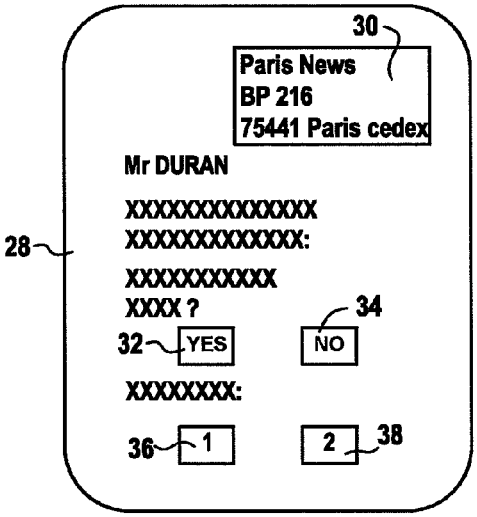

FIGS. 2A and 2B are respectively front and back views of an example of a reply card 28 that is necessary for implementing the present invention.

The front of the card shown in FIG. 2A is entirely identical to the front of a conventional reply card and thus bears the return address of the card that is designed to appear through the transparent window of an envelope, and various boxes disposed in identified zones 32, 34, 36, 38 of the reply card and that should be marked in order to answer the questions or requests from the sender that, in this example, concern subscription to a professional journal. For example, in the example shown, the recipient of the reply card, Mr Duran, is asked whether (zone 32) or not (zone 34) he wants to take up the offer of a subscription to that journal and, if so, if he wishes to subscribe for one (zone 36) or two (zone 38) years.

FIG. 2B shows the back of the card and thus its particular feature of having, on its back, a plurality of codes printed using a conductive ink, e.g. a metallic ink. The code referenced 40 is a unique identification code that is associated with the recipient of the reply card and that, when the reply card is read, makes it possible to retrieve from the database 26 the various data relating to the commercial operation that required the reply card to be sent. The codes 42, 44, 46, and 48 are codes that are all different, and that are associated with respective ones of the questions or requests asked of the recipient by the sender of the reply card.

Figure 3:
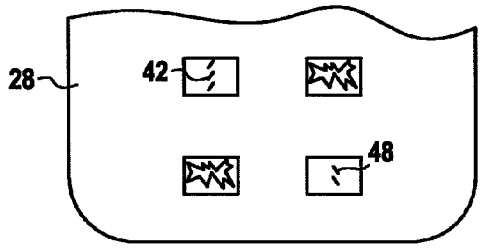

FIG. 3 is a fragmentary view of the same back of the reply card once the recipient has made the choices and answered the requests of the sender. With the present invention, instead of merely marking the boxes in question, the recipient perforates them in order to detach the codes printed on the backs of said boxes so as to prevent those codes from being read by the read device 24. Thus, in the example shown, the "YES" box of the zone 32 that bears the code 44 on its back, and the "2" box of the zone 38 that bears the code 46 on its back have been perforated, indicating that the recipient Mr Duran wishes to subscribe to the professional journal in question for two years.

Figure 4:
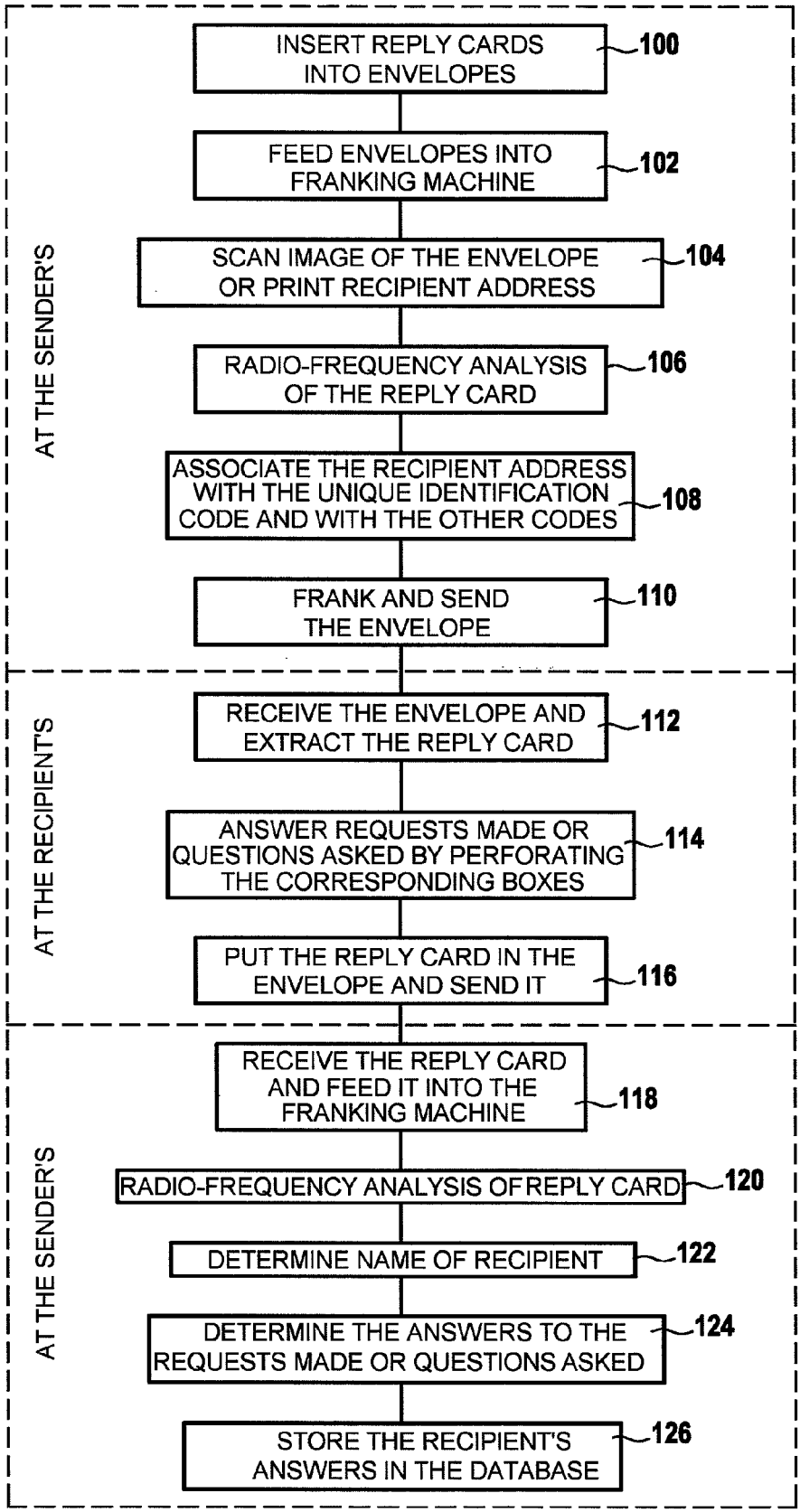
FIG. 4 shows the various steps of the method of the invention for processing reply cards.

The various steps for implementing the method of processing reply cards are described below with reference to FIG. 4. Said method can be broken down essentially into three stages, a send stage during which the reply cards are sent by the sender, a read and answer stage during which they are read and answered by the recipient, and a receive and process stage during which said reply cards are received by the sender for processing.

The first step 100 of the send stage consists in taking the reply cards, each of which is provided with the unique identification code 40 generated and printed while they are being manufactured, and inserting them into their respective envelopes, it being possible for this step to be performed by the sender by hand or by means of a conventional document inserter or envelope stuffer. Then in a step 102, the envelopes containing their reply cards are placed in the feed module of the mail-handling machine in which the process of franking each of the envelopes can then start. This process includes, in particular, while each envelope is passing through the module 20, a step 104 in which the envelope is scanned by the image sensor 22 that extracts from the resulting image the recipient address on the envelope, and a step 106 in which said envelope is analyzed by the read device 24 that reads the unique identification code of the reply card inserted in said envelope. In the next step 108, the recipient address, the unique identification code, and the various possible answers are associated in the database 26. In parallel, or immediately afterwards, the envelope is franked in a step 110 that ends the send stage at the sender's premises, prior to the envelope being sent to its recipient.

With the recipient, once the recipient has opened the envelope, said recipient can extract the reply card therefrom in the step 112, and can then make the choices that are required by the questions or requests asked to said recipient, by perforating the corresponding boxes and thus by detaching the associated codes from said boxes in a step 114. It then merely remains for the recipient to return the reply card in the envelope provided, which envelope is pre-franked or to be franked (in certain special cases when the risk of the reply card being lost or damaged is not an overriding concern, the card itself can be pre-franked or can receive franking) in a final step 116.

The envelope containing its reply card is then received by the initial sender in a step 118 in which it is fed back into the mail-handling machine, this time not to be franked but rather merely to be read. Thus, in a step 120, without opening the envelope, the read device 24 reads the information printed on the reply card, the unique identification code and the codes still present on said reply card. In a step 122, the read device deduces the name of the recipient from the unique identification code, and in a step 124, the read device interprets (decodes) the codes still present, i.e. not perforated or detached from said reply card, so as to determine the various answers given by the recipient to the questions or requests made by the sender. In an end step 126, said answers are then stored in the database for subsequent processing.

In an alternative embodiment, it is possible for the image sensor 22 to be omitted from the module 20, and for said module also to be provided with print means (not shown) for printing the recipient addresses on blank envelopes into which the reply cards have already been inserted. In which case, the above-mentioned step 104 does not consist in scanning the envelope to extract the address of the recipient, but rather in printing said address directly on the envelope by using the print means. Naturally, the module 20 that is presented as being part of the mail-handling machine can also be formed of a module external to the mail-handling machine.

It should also be noted that although, in the above-described mail-handling machine, the radio-frequency device is incorporated into an independent module, it can naturally also be disposed in any one of the modules of the mail-handling machine, such as the folder/stuffer, the feeder, and more precisely the mailpiece selection portion thereof, the dynamic scales, the franking machine or "postage meter" proper, or indeed the mailpiece-receiving magazine, and more precisely the conveyor portion thereof.

Thus, with the present invention, it is no longer necessary to open the envelopes, and the recipient's answers can be interpreted rapidly and automatically without using costly analysis tools (printing codes using a conductive ink is a very low cost operation). In addition, the recipient no longer needs any special equipment in order to answer the sender.

What is claimed is:

1. A method of processing a reply card returned by its recipient, the method being performed by a sender of said reply card, in which reply card said recipient has answered at least one request made by said sender by taking at least one determined physical action on at least one identified zone of said reply card, wherein said method includes radio-frequency analysis of said reply card by a radio-frequency read device for the purpose of determining whether or not said at least one identified zone is provided with a succession of signs printed with a conductive ink, the radio-frequency image of the positions of the signs making it possible to interpret the answer given by said recipient to said at least one request made by said sender as a function of whether or not said succession of signs printed with conductive ink in said at least one identified zone is present, wherein said radio-frequency analysis further includes recognition of the recipient based on a unique identification code printed with a conductive ink in another identified zone of said reply card.

2. A method according to claim 1, wherein said determined physical action includes perforating at least one said identified zone so as to detach at least a portion of said succession of signs printed with a conductive ink from said reply card, the effect of said detaching being to prevent a radio -frequency read device possessed by the sender from receiving the answer associated with said succession of signs printed with a conductive ink and detached by the recipient.

3. A method according to claim 1, wherein said unique identification code is associated in a database with a recipient address scanned or printed during the processing of said reply card that is performed by said sender.

4. A reply card enabling a recipient of said reply card to answer at least one request made by a sender of said reply card by taking a determined physical action on at least one identified zone of said reply card, wherein said at least one identified zone is provided with a succession of signs printed with a conductive ink, wherein said determined physical action includes perforating at least one said identified zone so as to detach at least a portion of said succession of signs printed with a conductive ink from said reply card, the effect of said detaching being to prevent a radio-frequency read device possessed by the sender from receiving the answer associated with said succession of signs printed with a conductive ink and detached by the recipient and the reply card further bearing a unique identification code printed with a conductive ink in another identified zone of said reply card and designed to make it possible to recognize the recipient.

5. A reply card according to claim 4, further bearing a unique identification code printed with a conductive ink in another identified zone of said reply card and designed to make it possible to recognize the recipient.

6. A module of a mail-handling machine, which module is suitable for enabling a reply card returned by its recipient to its sender to be processed by said sender, and in which reply card said recipient has answered at least one request made by said sender by taking at least one determined physical action on at least one identified zone of said reply card, wherein said module includes a radio-frequency analysis device for using radio-frequency analysis of said reply card to determine whether or not said at least one identified zone is provided with a succession of signs printed with a conductive ink, the radio-frequency image of the positions of the signs making it possible to interpret the answer given by said recipient to said at least one request made by said sender as a function of whether or not said succession of signs printed with conductive ink in said at least one identified zone is present, and wherein said radio-frequency read device also recognizes the recipient on the basis of a radio-frequency analysis of a unique identification code printed with a conductive ink in another identified zone of said reply card.

7. A module according to claim 6, that is connected to a database in which said unique identification code is associated with a recipient address scanned or printed while said reply card is being processed by said sender.

8. A module according to claim 6, constituting one of the following modules of the mail-handling machine: a folder/stuffer, a feeder, dynamic scales, a franking machine, and a mailpiece-receiving magazine.

9. A module according to claim 6, wherein said determined physical action includes in perforating at least one said identified zone so as to detach at least a portion of said succession of signs printed with a conductive ink from said reply card, the effect of said detaching being to prevent a radio-frequency read device possessed by the sender from receiving the answer associated with said succession of signs printed with a conductive ink and detached by the recipient.

* * * * *